US007766181B2

(12) United States Patent
Fogle et al.

(10) Patent No.: US 7,766,181 B2
(45) Date of Patent: Aug. 3, 2010

(54) HEAT RESISTANT LID FOR MICROWAVE CONTAINER

(75) Inventors: James C. Fogle, Marietta, GA (US); Colin P. Ford, Woodstock, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 899 days.

(21) Appl. No.: 11/081,194

(22) Filed: Mar. 16, 2005

(65) Prior Publication Data

US 2006/0207906 A1 Sep. 21, 2006

(51) Int. Cl.
*B65D 41/56* (2006.01)
*B65D 25/00* (2006.01)
*B65D 3/00* (2006.01)

(52) U.S. Cl. ..... 220/212; 220/62; 229/404

(58) Field of Classification Search ..... 220/890, 220/522; 229/901; 215/200; 53/487, 491, 53/485; 493/102, 84; *B65D 85/72, 71/42, B65D 71/00*

See application file for complete search history.

(56) References Cited

U.S. PATENT DOCUMENTS 1,335,296 A * 3/1920 Postal et al. ..... 220/62
2,823,063 A * 2/1958 Toensmeier ..... 294/87.2
2,844,245 A 7/1958 Gruber et al.
2,919,844 A * 1/1960 Anderson, Jr. ..... 229/120.011
3,016,259 A * 1/1962 Lawrence ..... 294/87.2
3,075,799 A 1/1963 Weiss
3,123,213 A * 3/1964 Kulig ..... 206/158
3,151,802 A * 10/1964 Spery ..... 206/140
3,245,711 A * 4/1966 Dantoin ..... 294/87.2
3,414,313 A * 12/1968 Schwarz ..... 294/87.2
3,616,897 A * 11/1971 Vrana ..... 206/568
3,661,417 A * 5/1972 Inman ..... 294/87.2
3,675,764 A 7/1972 Dutcher
3,701,416 A 10/1972 Lawrence
3,756,394 A * 9/1973 Huault ..... 206/431
4,139,094 A * 2/1979 Berry et al. ..... 206/158
4,192,540 A * 3/1980 Oliff ..... 294/87.2
4,272,010 A 6/1981 Capo
4,336,898 A 6/1982 Joyce
4,449,744 A 5/1984 Vossen
4,621,734 A 11/1986 Heijnen et al.
5,058,735 A * 10/1991 Bienaime ..... 206/145
5,103,971 A * 4/1992 Schuster ..... 206/153

(Continued)

FOREIGN PATENT DOCUMENTS

BE 904404 6/1986

(Continued)

*Primary Examiner*—Anthony Stashick
*Assistant Examiner*—Robert J Hicks
(74) *Attorney, Agent, or Firm*—Womble Carlyle Sandridge & Rice, PLLC

(57) ABSTRACT

A lid can be attached to a top of a microwaveable container. The lid can be made from paperboard, hard paper, and other materials, and can serve to cover an open top of the microwaveable container to prevent the contents of the container from splattering during heating. After heating, the lid also provides a surface by which a consumer can safely handle the heated container. The top panel of the lid can have smooth, continuous and uninterrupted surface, without creases or joints, that is suitable for advertising and product information and graphics.

38 Claims, 10 Drawing Sheets

U.S. PATENT DOCUMENTS

| | | | | | |
|---|---|---|---|---|---|
| 5,135,104 | A | * | 8/1992 | Jorba | 206/151 |
| 5,163,548 | A | | 11/1992 | Domansky | |
| 5,201,412 | A | * | 4/1993 | Schuster et al. | 206/153 |
| 5,351,815 | A | * | 10/1994 | Fogle et al. | 206/153 |
| 5,355,999 | A | * | 10/1994 | Sutherland | 206/153 |
| 5,364,333 | A | * | 11/1994 | Gulliver et al. | 493/84 |
| 5,415,278 | A | | 5/1995 | Sutherland | |
| 5,921,392 | A | * | 7/1999 | Davis | 206/434 |
| 6,223,892 | B1 | * | 5/2001 | Bakx | 206/148 |
| 6,378,697 | B1 | * | 4/2002 | Sutherland et al. | 206/140 |
| 6,422,453 | B1 | | 7/2002 | Wang | |
| 6,488,322 | B2 | * | 12/2002 | Bakx | 294/87.2 |

FOREIGN PATENT DOCUMENTS

| | | | | |
|---|---|---|---|---|
| DE | 103 04 527 | A1 | | 8/2004 |
| EP | 108614 | B1 | * | 1/1987 |
| WO | WO 9314993 | A1 | * | 8/1993 |
| WO | WO 02/059011 | A2 | | 8/2002 |

* cited by examiner

HEAT RESISTANT LID FOR MICROWAVE CONTAINER

BACKGROUND

1. Technical Field

The technical field relates to lids or covers for containers. More particularly, the technical field relates to lids for microwaveable containers that allow for safe handling of the containers after heating.

2. Related Art

Microwaveable containers are known. Such containers may have the form of a tub or tray having a metal rim at their upper portions. The top of such a container may be closed by a metal cover having a pull tab, which is used to remove the cover before heating the container contents in a microwave oven. Removing the cover would leave the container open, however, and the heated contents of the container, unless otherwise covered, would splatter onto interior surfaces of the microwave oven.

One solution to this problem is to place a plastic lid over the container. The plastic lid may be vented to prevent excessive pressure buildup during heating, and can be shaped for an interference fit with the top of the container. The plastic lid is removed before heating to allow access to the pull tab for removal of the metal cover. The plastic lid is then replaced on the container before heating to cover the resulting opening in the container and to prevent splattering of the container contents. Plastic lids, while effective, are relatively expensive to produce and must be manufactured within relatively tight tolerances. In some applications, plastic lids may also fail to provide sufficient protection to a consumer attempting to pick up and carry the heated microwave container.

Another solution is to include a paperboard lid on the container. A paperboard lid can be formed from a paperboard blank, and can be removable from the container. As in the case of the plastic lid, the paperboard lid is removed to allow the metal cover of the container to be removed, and is replaced on the container prior to heating. The paperboard lid therefore prevents splattering of the container contents during heating, and allows the consumer to hold the heated container.

Known paperboard lids, however, are deficient in that they do not provide a suitable surface for displaying advertising or other product information.

There is therefore a need for an inexpensive way to cover a container that provides a surface for displaying advertising or other product information and that also provides protection for a user attempting to hold and/or carry the heated container.

SUMMARY

According to a first embodiment, a lid blank for assembling into a lid comprises a top panel, a first side panel, a bottom panel, at least one top-receiving cut pattern in the bottom panel sized to receive an upper portion of a container, a second side panel, and a closure panel. In the assembled lid, the top panel is adjacent to the first side panel and the second side panel, and the bottom panel is adjacent to the first side panel and the second side panel.

According to the first embodiment, a lid can be assembled from the lid blank that has a smooth continuous top panel. The top panel is therefore particularly suitable for printing product, advertising, or other information. Logos, product identifiers, and other images can also be placed on the top panel.

The lid can be placed on, for example, a microwaveable container having a removeable metal cover. When the metal cover is removed prior to heating in a microwave oven, the lid covers the top of the container so that the contents of the container do not splatter during heating. Also, after heating, a consumer can hold the lid-container combination by the lid rather than by the container itself, which might otherwise be too hot too safely touch and/or handle.

In some embodiments, various mechanical closure mechanisms can be included on the blank to allow for assembly of a lid. The mechanical closure mechanism can be, for example, a closure tab and closure aperture arrangement. In another embodiment, the closure panel can be secured by adhesive.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWING FIGURES

DETAILED DESCRIPTION

The present embodiments are addressed to lids for attachment to containers. A lid 100 is illustrated in its assembled state in FIG. 5, in which it is attached to a microwaveable container 200. The lid 100 can be placed on the container, for example, to prevent the contents of the container 200 from splattering during heating. The lid 100 also allows a consumer or other user to pick up and handle the heated container 200 without burning his or her hands after heating of the container 200. The lid 100 is inexpensive and easy to assemble, and can include a mechanical closure mechanism that does not require adhesive for assembly. The top panel of the lid 100 can comprise a smooth continuous surface suitable for the placement of advertising, product information, and other graphical or textual information.

Figure 1:
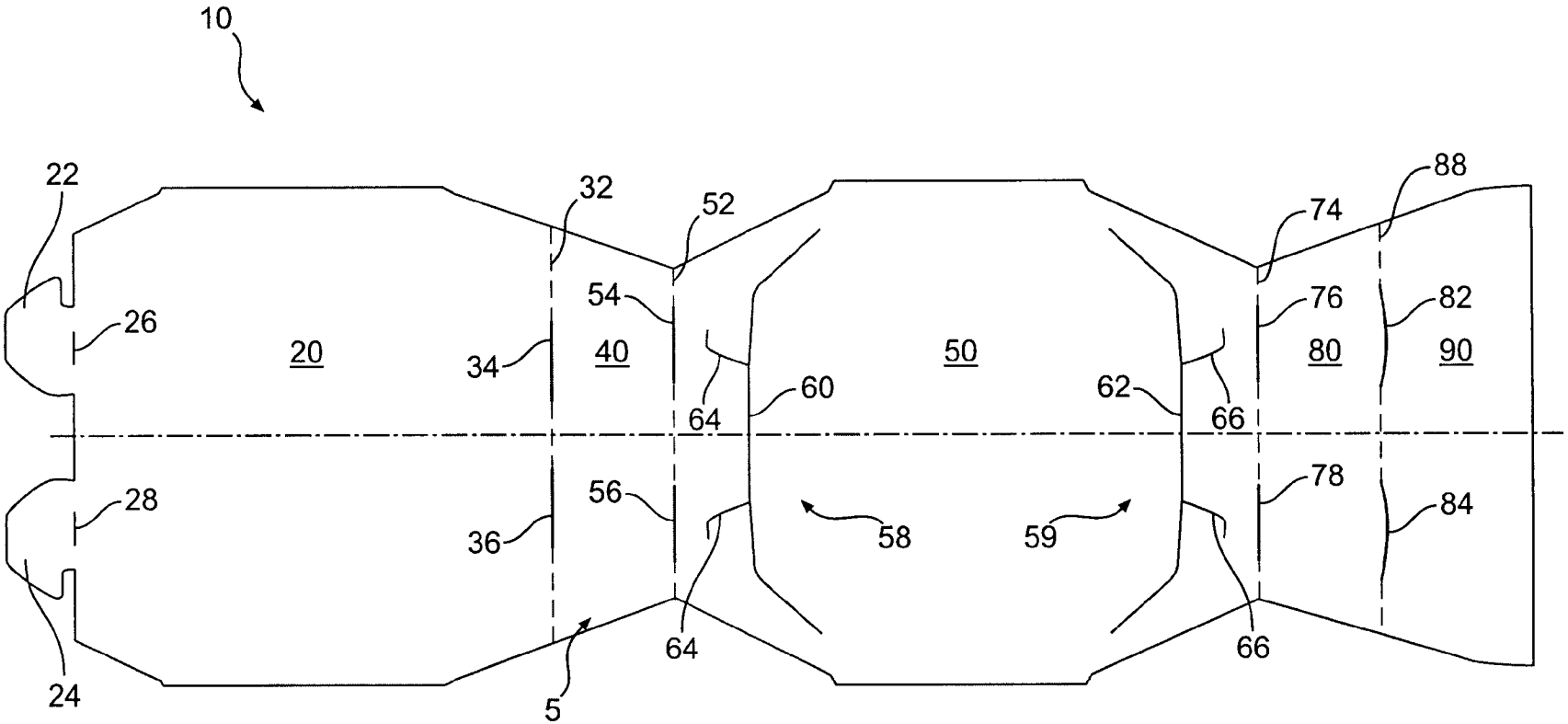
FIG. 1 is a plan view of a blank used to form a lid according to a first embodiment.

FIG. 1 is a plan view of a first side 5 of a blank 10 used to form the lid 100, according to a first embodiment. The blank 10 comprises a top panel 20 with two closure tabs 22, 24 extending from a first side of the top panel 20. Tab cuts 26, 28 may be formed in the blank 10 at the base of each closure tab 22, 24, respectively, to enable pivoting of the closure tabs 22, 24 in and out of the plane of the blank 10. The top panel 20 is foldably connected to a first side panel 40 at a first fold line 32. One or more first cut lines 34, 36 may also be formed in the blank 10 between the top panel 20 and the first side panel 40 to facilitate folding of the blank 10 at the first fold line 32. Any number of cut lines may be formed along the fold line 32, and the number and length of the cut lines may be selected according to, for example, the gauge and the stiffness of the material used to form the blank 10.

The first side panel 40 is foldably connected to a bottom panel 50 at a second fold line 52. One or more second cut lines 54, 56 may be formed in the blank 10 between the bottom panel 50 and the first side panel 40 to facilitate folding at the second fold line 52.

The bottom panel 50 includes a first top-receiving cut pattern 58 and a second top-receiving cut pattern 59 spaced from one another across a length of the bottom panel 50. The first top-receiving cut pattern 58 can include a first top-receiving cut line 60, and J-cuts 64 extending from intermediate points along the first top-receiving cut line 60. The second top-receiving cut pattern 59 can include a second top-receiving cut line 62 having J-cuts 66 extending from intermediate points along the second top-receiving cut line 62. The first and second top-receiving cut lines 60, 62 may be generally C-shaped. The first and second top-receiving cut patterns 58, 59 form the point of insertion for a rim of a container to protrude into the bottom panel 50 in the assembled lid 100. The J-cuts 64, 66 allow the top-receiving cut lines 60, 62 to flex and open in order to allow entry of a container top into the cut lines 60, 62.

The bottom panel 50 is foldably connected to a second side panel 80 at a third fold line 74. One or more third cut lines 76, 78 may be formed in the blank 10 between the bottom panel 50 and the second side panel 80 to facilitate folding at the third fold line 74.

The second side panel 80 is foldably connected to a closure panel 90 at a fourth fold line 88. Spaced closure apertures 82, 84 are generally aligned with the fourth fold line 88, and are sized to receive the closure tabs 22, 24. The closure apertures 82, 84, may be formed as, for example, cuts, slits, and other apertures.

As shown in FIG. 1, the blank 10 is generally rectangular at the top panel 20 and at a center portion of the bottom panel 50. The blank 10 narrows at the first fold line 32 and further narrows at the second fold line 52. Similarly, the blank 10 narrows at the fourth fold line 88 and further narrows at the third fold line 74.

Figure 2:
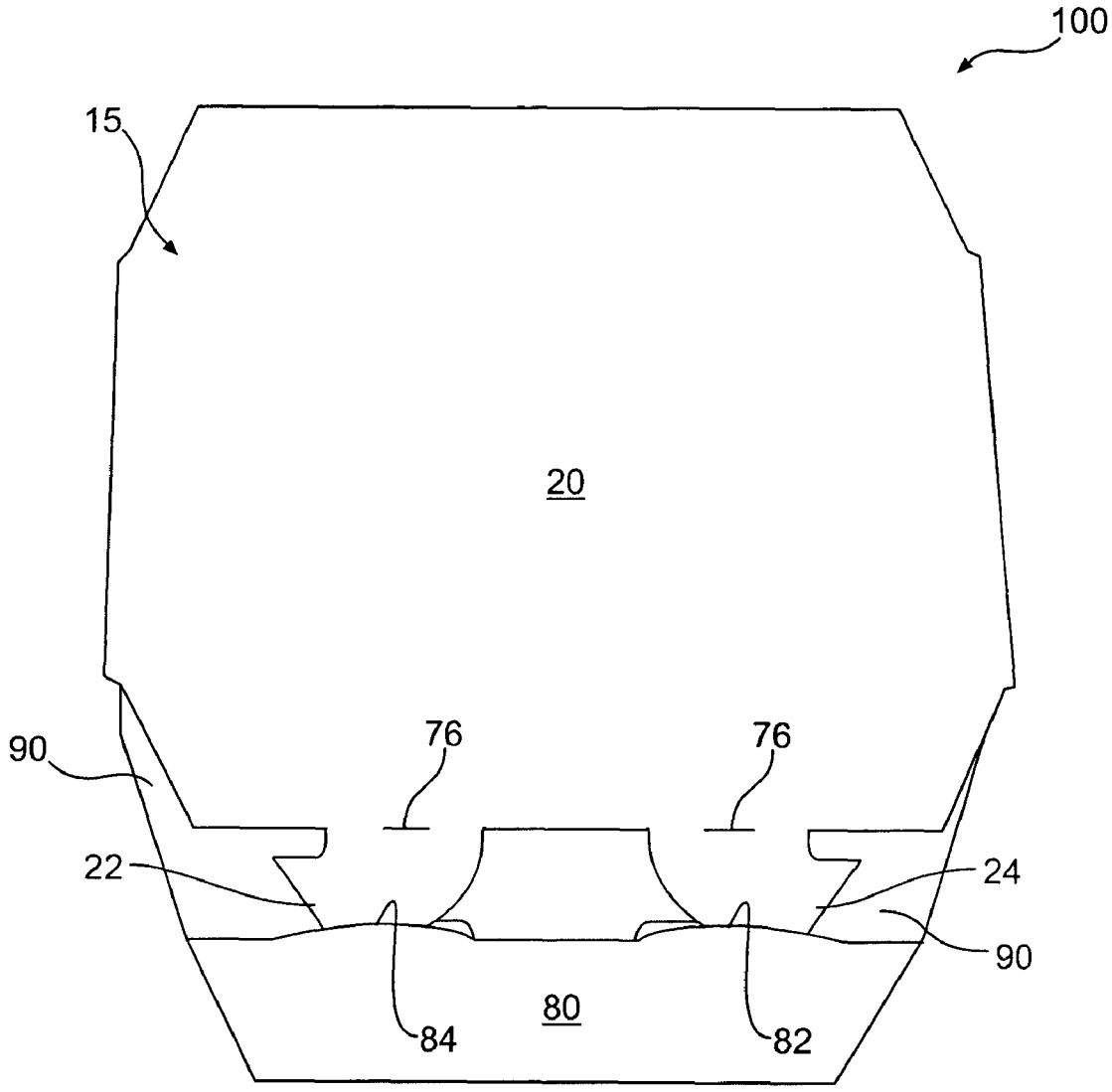
FIG. 2 is a perspective view of an assembly step of a lid formed from the blank of FIG. 1 before attachment to a tub container.

FIG. 2 is a perspective view of an assembly step of the lid 100 before attachment to the container 200. FIG. 1 illustrates the first side 5 of the blank 10, which is the 'underside' or 'interior' side of the assembled lid 100, while FIG. 2 illustrates the second or exterior side 15 of the blank 10 as the blank 10 is folded about the fold lines in the blank 10. Referring to FIGS. 1 and 2, the top panel 20 of the blank 10 is folded over by folding the blank 10 about the first and second fold lines 32, 52, with the second side 15 of the blank 10 outward. The closure panel 90 is folded over, also with the second side 15 outward, by folding the blank 10 about the third and fourth fold lines 74, 88. Folding about the fold lines 32, 52, 74, 88 brings the closure panel 90 into proximity with the top panel 20. At that time, the closure tabs 22, 24 may each be inserted into a respective one of the closure apertures 82, 84, which links the opposite ends of the blank 10, thereby 'closing' the lid 100.

Figure 3:
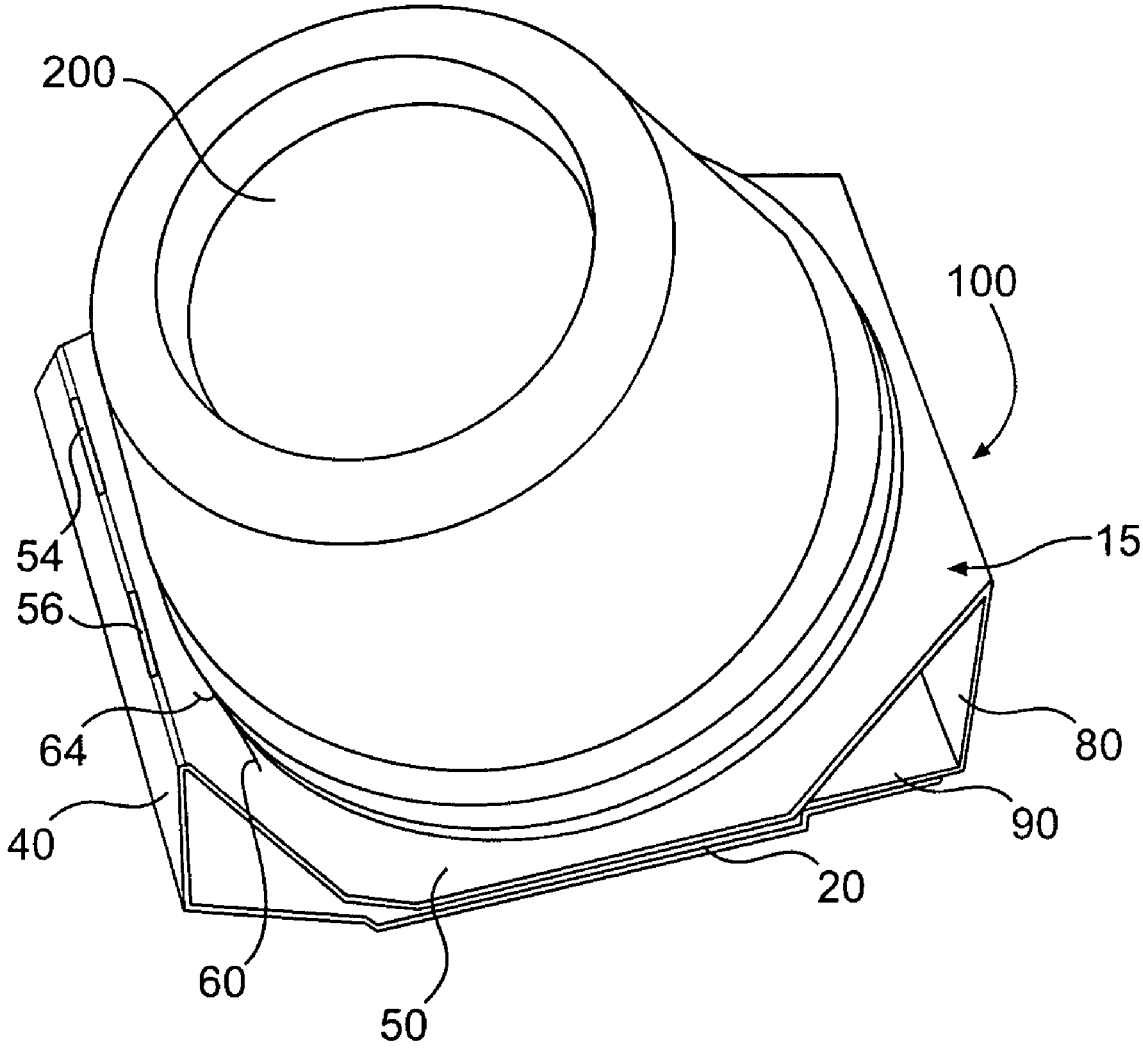
FIG. 3 is a perspective view of the assembled lid of FIG. 2 being attached to a tub container.

FIG. 3 illustrates the insertion of a container 200 into the lid 100. Referring to FIG. 3, the closed lid 100 is inverted and a top edge or rim of the top of the container 200 is inserted into the first top-receiving cut 60. When the container 200 top is inserted into the first top-receiving cut 60, the bottom panel 50 flexes at the first and second J-cuts 64, allowing the container top to enter the first top-receiving cut 60.

Figure 4:
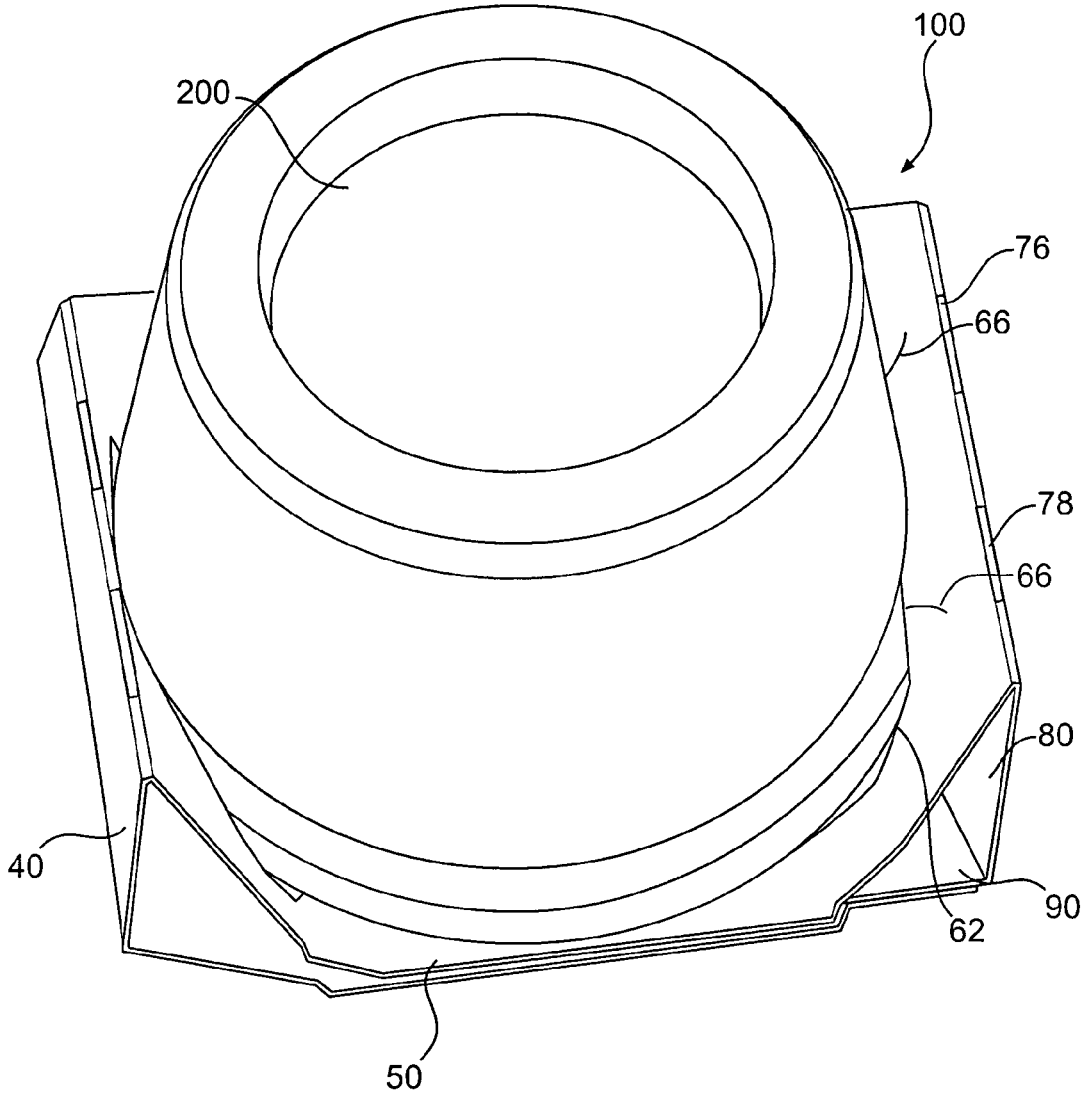
FIG. 4 is a perspective view of the assembled lid of FIG. 2 attached to a tub container.

Next, referring to FIG. 4, an opposite edge of the top or rim of the container 200 is inserted into the second top-receiving cut 62. The bottom panel 50 flexes at the third and fourth J-cuts 66 to ease insertion of the container 200. The container 200 is now fully seated in the lid 100.

Figure 5:
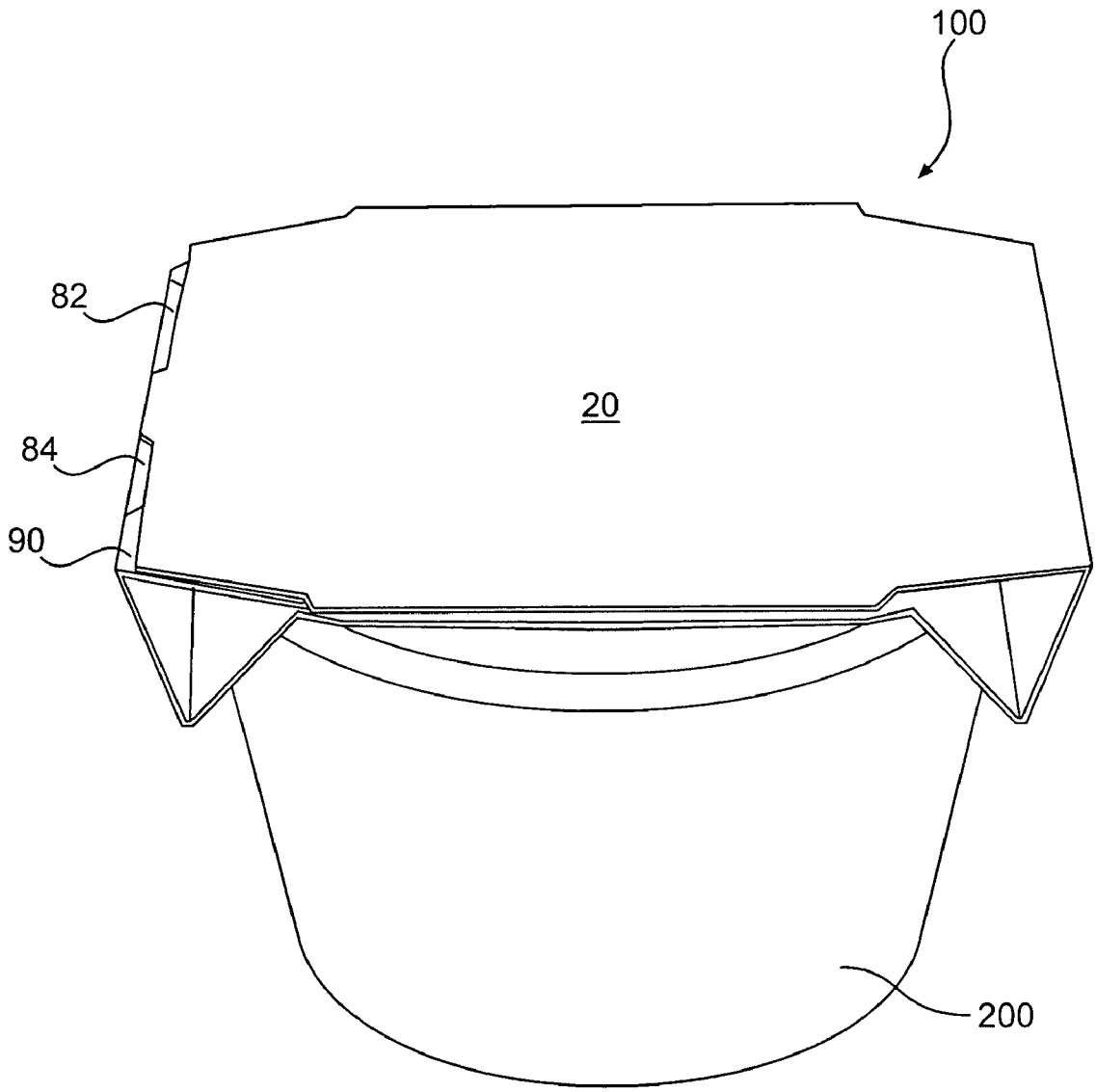
FIG. 5 is a perspective view of the assembled lid of FIG. 2 attached to the tub container in an upright position.

FIG. 5 is a perspective view of the assembled lid 100 attached to the tub container 200 in an upright position. When placed on the container 200, the first and second side panels 40, 80 extend generally vertically, and the top panel 20 extends generally horizontally across the top of the container 200. The bottom panel 50 also extends generally horizontally, and is sandwiched between the top of the container 200 and the top panel 20. As shown in FIG. 5, the upper surface of the top panel 20 is a smooth, uninterrupted surface, without creases, joints, or other surface irregularities, upon which advertising information, product information, or any other useful information and/or graphics can be printed.

According to the above embodiment, the lid 100 is securely held in a closed state by the mechanical interaction of the closure tabs 22, 24 with the closure apertures 82, 84. The lid 100 is easy to assemble and may be produced and assembled at a relatively low cost. No adhesives or other chemical joining means are required to maintain the lid 100 in a closed state.

Figure 6:
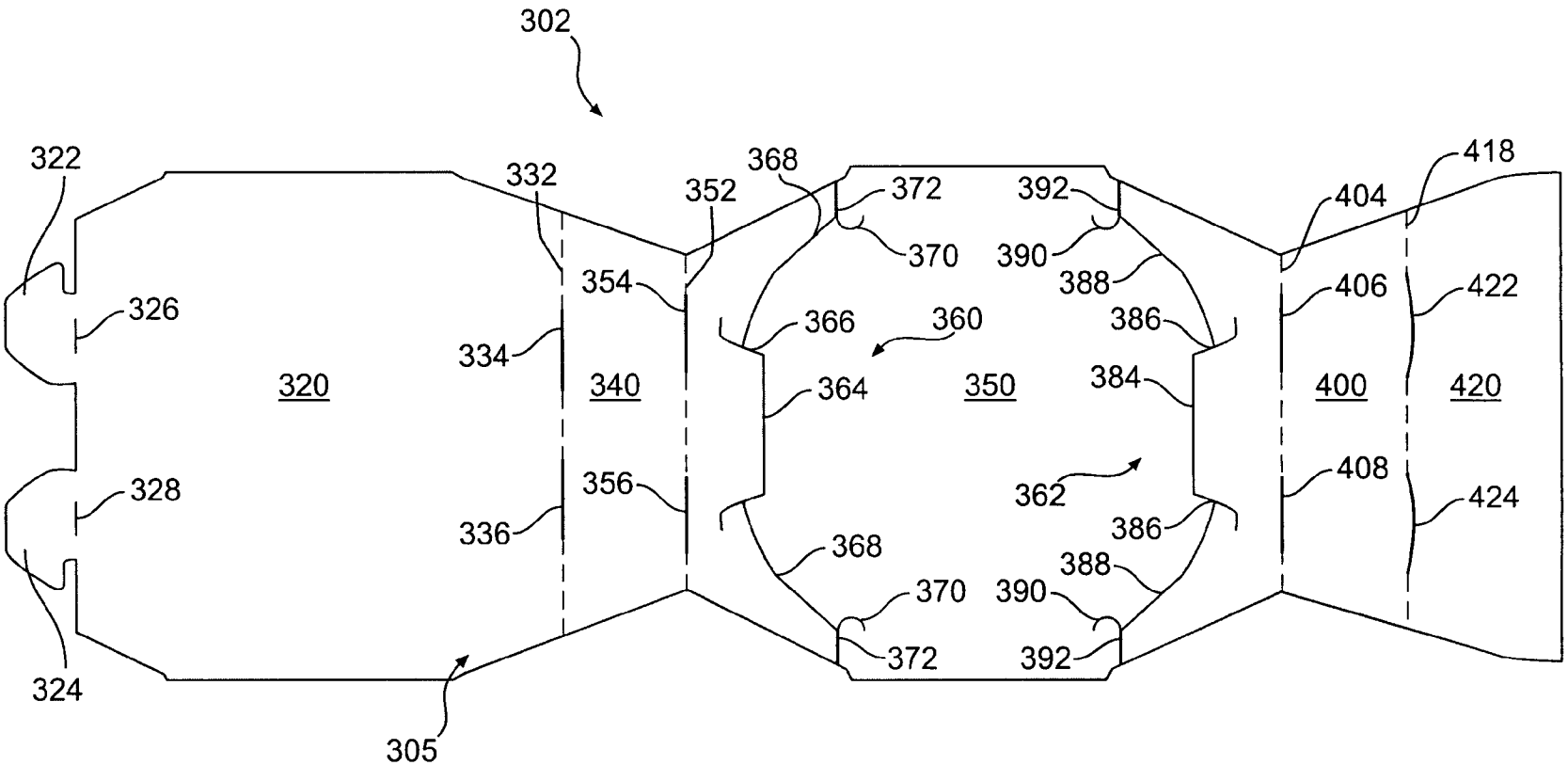
FIG. 6 is a plan view of a blank used to form a lid according to a second embodiment.

FIG. 6 is a plan view of a blank 302 used to form a lid 300 according to a second embodiment. The lid 300 is illustrated in assembled state in FIG. 7, in which it is attached to a microwaveable tub container 200. The lid 300 can be placed on the container, for example, to prevent the contents of the container 200 from splattering during heating, and to allow a consumer or other user to pick up and handle the heated container 200 without burning his or her hands. The lid 300 is inexpensive and easy to assemble, and can include a mechanical closure mechanism that does not require adhesive for assembly. The top panel of the lid 300 can comprise a smooth continuous surface suitable for the placement of advertising, product information, and other graphical or textual information.

FIG. 6 is a plan view of a first side 305 of a blank 302 used to form the lid 300. The blank 302 comprises a top panel 320 with two closure tabs 322, 324 extending from a first side of the top panel 320. Tab cuts 326, 328 may be formed in the blank 302 at the base of each tab 322, 324, respectively, to enable pivoting of the tabs 322, 324 in and out of the plane of the blank 302. The top panel 320 is foldably connected to a first side panel 340 at a first fold line 332. One or more first cut lines 334, 336 may also be formed in the blank 302 between the top panel 320 and the first side panel 340 to facilitate folding of the blank 302 at the first fold line 332. Any number of cut lines may be formed along the fold line 332, and the number and length of the cut lines may be selected, for example, according to the gauge and the stiffness of the material used to form the blank 302.

The first side panel 340 is foldably connected to a bottom panel 350 at a second fold line 352. One or more second cut lines 354, 356 may be formed in the blank 302 between the bottom panel 350 and the first side panel 340 to facilitate folding at the second fold line 352.

The bottom panel 350 includes a first top-receiving cut pattern 360 and a second top-receiving cut pattern 362 disposed on opposite sides of the bottom panel 350. The first top-receiving cut pattern 360 includes a first straight section 364 extending along the width of the blank 302, and J-cuts 366 extending outwardly from the ends of the straight section 364. Dogleg cuts 368 may intersect with and extend from the J-cuts 366, and C-cuts 370 may extend from the ends of the dogleg cuts 368. Fold lines 372 may extend from the C-cuts 370 to the edges of the bottom panel 350. The second top-receiving cut pattern 362 may be similar to the first top-receiving cut pattern 360, and may include a first straight section 384 extending along the width of the blank 302, J-cuts 386 extending outwardly from the ends of the straight section 384, dogleg cuts 388 extending from the J-cuts 386, and C-cuts 390 extending from the ends of the dogleg cuts 388. Fold lines 392 may extend from the C-cuts 390 to the edges of the bottom panel 350. The top-receiving cut patterns 360, 362 allow the bottom panel 350 to flex and open in order to allow entry of a container top into the bottom panel 350 of the assembled lid 300.

The bottom panel 350 is foldably connected to a second side panel 400 at a third fold line 404. One or more third cut lines 406, 408 may be formed in the blank 302 between the bottom panel 350 and the second side panel 400 to facilitate folding at the third fold line 404.

The second side panel 400 is foldably connected to a closure panel 420 at a fourth fold line 418. Closure apertures 422, 424 may be generally aligned with the fourth fold line 404, and are sized to receive the closure tabs 322, 324.

As shown in FIG. 6, the blank 302 is generally rectangular at the top panel 320 and at a center portion of the bottom panel 350. The blank 302 narrows at the first fold line 332 and further narrows at the second fold line 352. Similarly, the blank 302 narrows at the fourth fold line 418 and further narrows at the third fold line 404.

Figure 7:
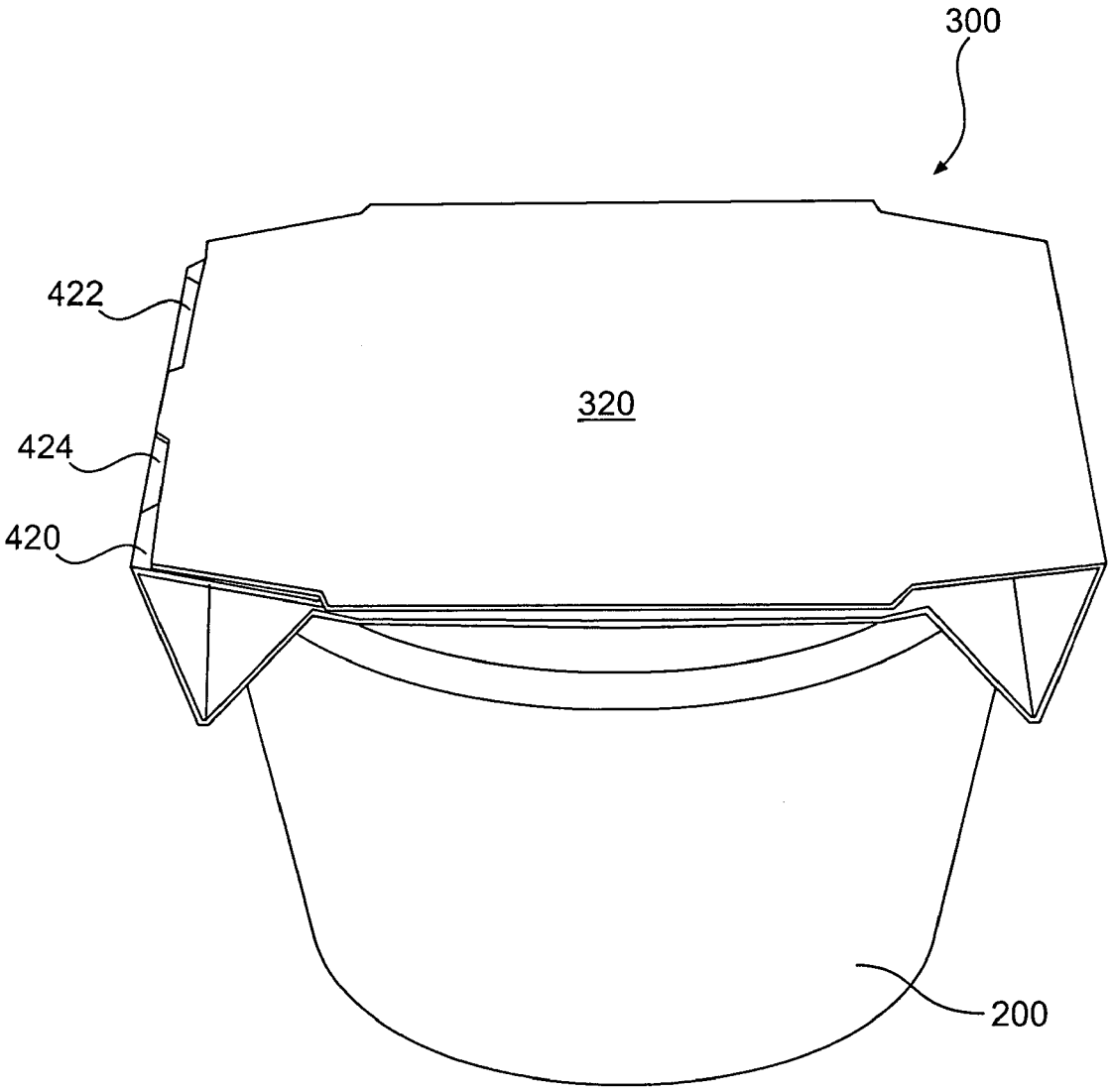
FIG. 7 is a perspective view of the assembled lid according to the second embodiment attached to a tub container.

FIG. 7 is a perspective view of the assembled lid 300 formed from the blank 302. The lid 300 can be assembled and mounted to the container 200 in a manner similar to the lid 100.

Figure 8:
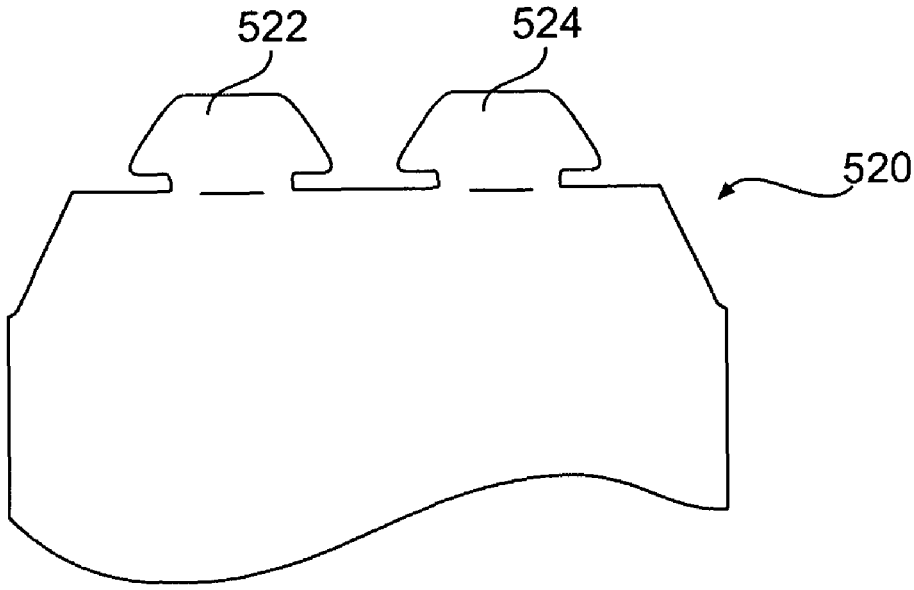
FIG. 8 is a plan view of a portion of an alternative top panel having a variant closure tab arrangement.

FIG. 8 is a plan view of a portion of an alternative top panel 520 having a variant closure tab arrangement. The top panel 520 has first and second closure tabs 522, 524 with two projections. The top panel 520 can be used in a blank similar to the blanks 10, 302 discussed above, with the closure aperture size selected to correspond to the size of the closure tabs 522, 524.

Figure 9:
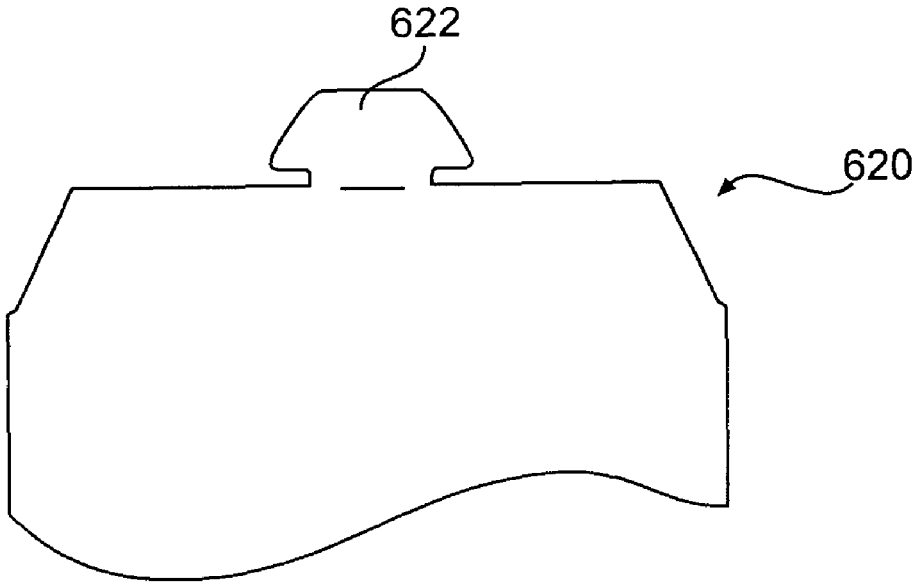
FIG. 9 is a plan view of a portion of another alternative top panel having a variant closure tab arrangement.

FIG. 9 is a plan view of a portion of yet another alternative top panel 620 having a variant closure tab arrangement. The top panel 620 has a single closure tab 622. The top panel 620 can be used in a blank similar to the blanks 10, 302 discussed above, with only one closure aperture required.

Figure 10:
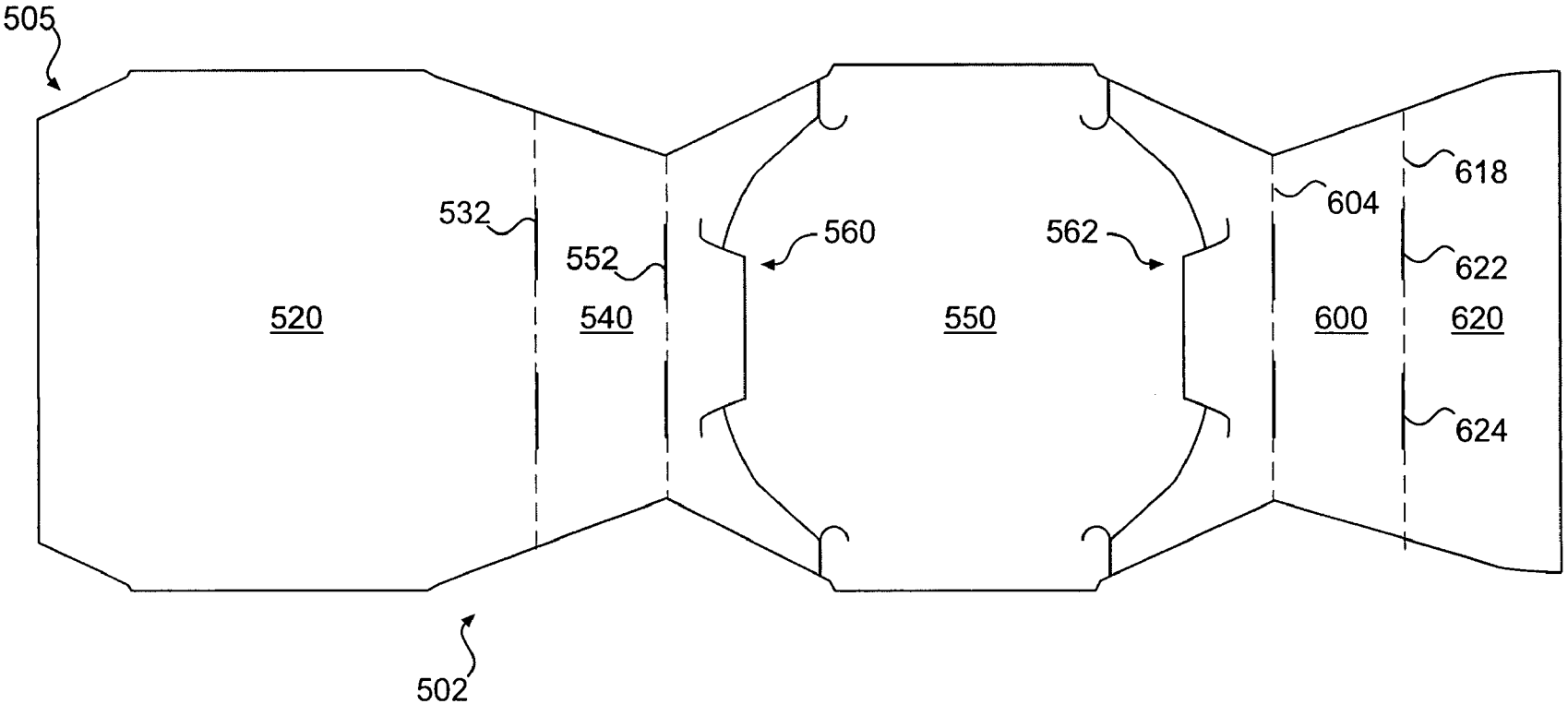
FIG. 10 is a plan view of a blank used to form a lid according to a third embodiment.

FIG. 10 is a plan view of a first side 505 of a blank 502 used to form a lid 500 according to a third embodiment. The lid 500 is illustrated in an assembled state in FIG. 11, in which it is attached to a microwaveable tub container 200. The top panel 520 of the lid 500 can comprise a smooth continuous surface suitable for the placement of advertising, product information, and other graphical or textual information.

The blank 502 comprises the top panel 520, a first side panel 540, a bottom panel 550, a second side panel 600, and a closure panel 620. First, second, and third fold lines 532, 552 and 604 can be of similar construction to the fold lines 332, 352, and 404 shown in FIG. 6. First top-receiving cut pattern 560 and second top-receiving cut pattern 562 can also be of similar construction to those shown in FIG. 6. Alternatively, top-receiving cut patterns such as the patterns 58, 59 illustrated in FIG. 1 can be used in the blank 502.

The blank 502 differs from the blank shown in FIG. 6 in that a closure panel 620 is connected to the second side panel 600 by a fourth fold line 618, and there are no closure tabs or apertures. Instead, the blank 502 is closed by gluing the closure panel 620 to the underside of the top panel 520. The fold line 618 can include first and second cut lines 622, 624 to facilitate folding at the fourth fold line 618.

Figure 11:
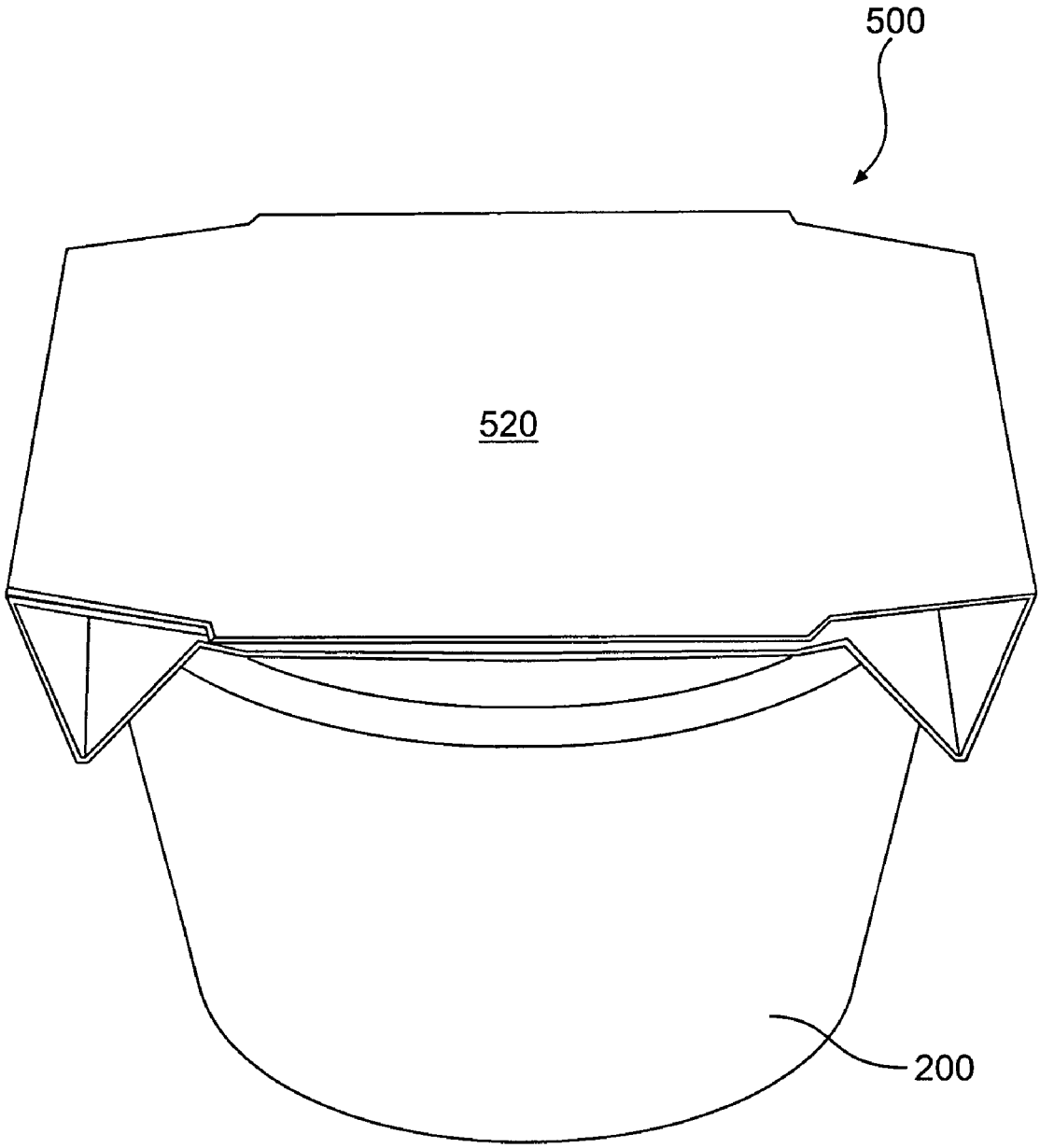
FIG. 11 is a perspective view of the assembled lid of FIG. 10 being attached to a tub container.

FIG. 11 is a perspective view of the assembled lid 500 formed from the blank 502. The lid 500 can be assembled and mounted to the container 200 in a manner similar to the lid 100. Instead of engaging closure tabs with closure apertures, however, the closure panel 620 is glued to the underside of the top panel 520. One or more sides of the closure panel 620, can be, for example, untreated with varnish or other coatings to aid in adhering the closure panel 620 to the top panel 520. The top panel 520 can also be untreated with varnish or similar treatments at a the point of adhesion with the closure panel 620.

The bottom panels in the above embodiments illustrate exemplary arrangements for receiving the top of a container within the bottom panel of a lid. Other arrangements may be provided, however, to allow a container to be inserted into the lid.

The blank 10 can be, for example, formed from hard paper, paperboard and similar materials. The first and second sides of the blanks can be coated with, for example, a clay coating. The clay coating may then be printed over with product, advertising, and other information or images. The blank may then be coated with a varnish to protect any information printed on the blank. The blanks may also be coated with, for example, a moisture barrier layer, on either or both sides of the blanks.

In the above embodiment, the lids 100, 300, 500 are shown as accommodating a generally cylindrical or frustoconical tub container 200 having a round upper rim. Other types of containers, however, can be covered by a lid according to the present invention. For example, a parallelepipedal container can be accommodated in a lid having the general configuration of the lids 100, 300, 500, by varying the shape of the cuts in the bottom panels of the blanks, or by providing alternative cuts or apertures in the bottom panels. The dimensions of the blanks may also be altered, for example, to accommodate various container forms.

The embodiments disclosed above include a closure mechanism that connects the second side panel with the top panel. The blanks may be constructed, however, so that the closure mechanisms connect different panels. For example, referring to FIG. 1, the elements of the blank 102 may be shifted so that the top panel 20 is foldably connected to the second side panel 80. A closure panel could extend from either side of the blank, with locking tabs on the opposite side, thereby providing a closure mechanism to assemble a lid from the blank.

In the above embodiments, the fold lines may be formed in the blanks by any appropriate method. For example, the fold lines can be formed by creasing or scoring a part of the blanks. Other methods for forming fold lines in blanks may also be used.

The above embodiments are addressed to lids which are suitable for attachment to plastic microwaveable tubs. Lids according to the above embodiments could, however, be adapted for use with containers such as cups, trays or bowls. In such embodiments, a cup, tray or bowl, which could be made from plastic, for example, could include a plastic film or other material cover which could be removed prior to heating. A lid according to the present invention could thereafter be placed on the lid or bowl prior to heating.

The foregoing description of the invention illustrates and describes the present invention. Additionally, the disclosure describes only selected preferred embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

The description is not intended to limit the invention to the form disclosed herein. Also, it is intended that the appended claims be construed to include alternative embodiments, not explicitly defined in the detailed description.

What is claimed is:

1. A lid blank assembled into a lid, in combination with a container, the container having an opening positioned in an upper portion of the container for accessing contents of the container, the lid comprising:

a top panel;

a bottom panel;

at least one top-receiving cut pattern located at an interior region of said bottom panel, the top-receiving cut pattern being engaged with the upper portion of the container such that the upper portion of the container extends through the bottom panel, the bottom panel covering the opening of the container such that the contents of the container are directly adjacent to the bottom panel;

a first side panel foldably connected to the top panel and the bottom panel;

a second side panel foldably connected to the bottom panel; and a closure panel directly foldably connected to the second side panel, wherein said top panel is adjacent to said first side panel and said second side panel and overlaps said closure panel, said closure panel extends substantially parallel to said top panel, and said bottom panel is adjacent to said first side panel and said second side panel.

2. The combination of claim 1, further comprising a mechanical closure mechanism closing said lid.

3. The combination of claim 2, wherein said mechanical closure mechanism comprises:

at least one closure tab; and at least one closure aperture engaged with said at least one closure tab.

4. The combination of claim 3, wherein said at least one closure aperture is generally disposed along a fold line connecting the closure panel to the second side panel.

5. The combination of claim 3, wherein said at least one closure tab comprises two closure tabs, and said at least one closure aperture comprises two closure apertures.

6. The combination of claim 1, wherein said at least one top-receiving cut pattern comprises:

a first top-receiving cut pattern located on a first side of said bottom panel; and a second top-receiving cut pattern located on a second side of said bottom panel.

7. The combination of claim 6, wherein said first top-receiving cut pattern comprises:

a first top-receiving cut;

at least one first J-cut extending from said first top-receiving cut; and at least one second J-cut extending from said second top-receiving cut.

8. The combination of claim 7, wherein said first top-receiving cut is generally C-shaped.

9. The combination of claim 6, wherein said first top-receiving cut pattern comprises:

a first straight portion extending along a width of said blank; and

J-cuts extending from ends of said straight portion.

10. The combination of claim 9, wherein said first top-receiving cut pattern further coprises:

dogleg cuts extending from said J-cuts; and

C-cuts extending from said J-cuts.

11. The combination of claim 6, wherein said first top-receiving cut pattern and said second top-receiving cut pattern are spaced from one another across a length of said bottom panel.

12. The combination of claim 1, wherein said blank is generally rectangular at said top panel and narrows at a location where said top panel is foldably connected to said first side panel.

13. The combination of claim 12, wherein said blank is generally rectangular at a center portion of said bottom panel and narrows at a location where said bottom panel is foldably connected to said first side panel.

14. The combination of claim 1, wherein said blank is constructed from paperboard or hard paper.

15. The combination of claim 1, wherein said top panel is an uninterrupted piece of paperboard free from creases or joints.

16. The combination of claim 3, wherein said at least one closure tab is engaged with said at least one closure aperture.

17. The combination of claim 16, wherein the upper portion of said container is disposed between the top panel and the bottom panel of the lid such that the lid at least partially obstructs the opening of the container.

18. The combination of claim 17, wherein said first side panel and said second side panel extend generally vertically, and said top panel extends generally horizontally.

19. The combination of claim 18, wherein said container is generally frustoconical.

20. The combination of claim 1, wherein said closure panel is glued to one of said remaining panels of said lid blank.

21. The combination of claim 20, wherein the upper portion of said container is engaged with said at least one top-receiving cut pattern of said lid.

22. The combination of claim 21, wherein said first side panel and said second side panel extend generally vertically, and said top panel extends generally horizontally.

23. The combination of claim 22, wherein said container is generally frustoconical.

24. A method of providing the combination of claim 3, comprising:

folding the blank into the lid;

engaging the at least one closure tab with the at least one closure aperture; and inserting the upper portion of the container into the at least one top-receiving cut pattern.

25. A method of providing the combination of claim 1, comprising:

folding the blank;

gluing the closure panel to one of the remaining panels in the lid blank; and inserting the upper portion of the container into the at least one top-receiving cut pattern.

26. A lid blank assembled into a lid, in combination with a container, the container including an opening in an open condition for accessing an interior space of the container, the lid comprising:

a top panel free from creases or joints;

a first side panel;

a bottom panel;

at least one top-receiving cut pattern located at an interior region of said bottom panel, the top-receiving cut pattern being engaged with an upper portion of the container such that the upper portion of the container extends through the bottom panel, the bottom panel being directly adjacent to and at least partially obstructing the opening of the container;

a second side panel;

a closure panel foldably connected to the second side panel;

at least one tab extending from the top panel; and at least one closure aperture generally disposed along a fold line connecting the closure panel to the second side panel, wherein said top panel is adjacent to said first side panel and said second side panel and overlaps said closure panel, said bottom panel is adjacent to said first side panel and said second side panel, said closure panel extends substantially parallel to said top panel, and said at least one tab is received in said at least one closure aperture for closing the lid.

27. The combination of claim 26, wherein said at least one top-receiving cut pattern comprises:

a first top-receiving cut pattern located on a first side of said bottom panel; and a second top-receiving cut pattern located on a second side of said bottom panel.

28. The blank combination of claim 26, wherein said blank is generally rectangular at a center portion of said bottom panel and narrows where said bottom panel is foldably connected to said first side panel.

29. The combination of claim 26, wherein the upper portion of said container is disposed between the top panel and the bottom panel of the lid.

30. A lid blank assembled into a lid, in combination with a container, the container including an opening for accessing contents of the container, the lid comprising:

a top panel;

a first side panel;

a bottom panel;

container-receiving means located at an interior region of said bottom panel, the container-receiving means being engaged with an upper portion of the container such that the upper portion of the container extends through the bottom panel, the bottom panel at least partially covering the opening of the container such that the contents of the container are in open communication with the bottom panel;

a second side panel;

a closure panel directly foldably connected to the second side panel;

at least one closure tab; and at least one closure aperture sized to receive said at least one closure tab, wherein said top panel is adjacent to said first side panel and said second side panel and overlaps said closure panel, said closure panel extends substantially parallel to said top panel, and said bottom panel is adjacent to said first side panel and said second side panel.

31. The combination of claim 30, wherein said top panel is an uninterrupted piece of paperboard free from creases or joints.

32. The combination of claim 30, wherein the upper portion of said container is disposed between the top panel and the bottom panel of the lid.

33. A method of providing the combination of claim 30, comprising:

folding said blank;

engaging said at least one closure aperture with said at least one closure tab; and inserting the upper portion of said container into said container-receiving means.

34. The blank combination of claim 30, wherein:

said blank is generally rectangular at said top panel and narrows at location where said top panel is foldably connected to said first side panel; and said blank is generally rectangular at a center portion of said bottom panel and narrows at a location where said bottom panel is foldably connected to said first side panel.

35. A lid blank assembled into a lid, in combination with a container the container including an opening for accessing an interior space of the container, the lid comprising:

a top panel;

a first side panel;

a bottom panel;

at least one top-receiving cut pattern located at an interior region of said bottom panel, the top-receiving cut pattern being engaged with an upper portion of a container such that the upper portion of the container extends through the bottom panel, the bottom panel at least partially covering the opening of the container such that the bottom panel is in open communication with the interior space of the container;

a second side panel; and a closure panel directly foldably connected to the second side panel, wherein said top panel is adjacent to said first side panel and said second side panel and overlaps said closure panel, said closure panel extends substantially parallel to said top panel, and said bottom panel is adjacent to said first side panel and said second side panel.

36. A lid blank assembled into a lid, in combination with a container, the container including an opening for accessing an interior space of the container, the lid comprising:

a top panel;

a bottom panel comprising at least one top-receiving cut pattern located at an interior region of the bottom panel, the top-receiving cut pattern being engaged with an upper portion of the container such that the upper portion of the container extends through the bottom panel, a central portion extending over the upper portion of the container and directly overlying the interior space of the container, such that the central portion at least partially obstructs the opening, and end portions extending outwardly from the central portion and separated from the central portion along the at least one top-receiving cut pattern;

a first side panel foldably connected to the top panel and the bottom panel;

a second side panel foldably connected to the bottom panel; and a closure panel foldably connected to the second side panel, wherein said top panel is adjacent to the first side panel and the second side panel, said bottom panel is adjacent to the first side panel and the second side panel, and said end portions are spaced from the top panel by a distance that is greater than a distance by which said central portion is spaced from the top panel.

37. The method of claim 24, wherein the container includes a cover closing the opening, and the method further comprises removing the cover before inserting the upper portion of the container into the at least one top-receiving cut pattern.

38. The method of claim 33, wherein the container includes a cover closing the opening, and the method further comprises removing the cover before inserting the upper portion of the container into said container-receiving means.

* * * * *